United States Patent [19]

Morrison

[11] Patent Number: 4,993,526

[45] Date of Patent: Feb. 19, 1991

[54] LUGGAGE-PROTECTIVE PAD INCLUDING INTEGRAL FEET AND BUMPER

[75] Inventor: David C. Morrison, Gallatin, Tenn.

[73] Assignee: Lenox Incorporated, Lawrenceville, N.J.

[21] Appl. No.: 284,995

[22] Filed: Dec. 15, 1988

[51] Int. Cl.[5] ..... A45L 13/36

[52] U.S. Cl. ..... 190/125; 190/37

[58] Field of Search ..... 190/18 R, 37, 100, 122, 190/127, 124–126

[56] References Cited

U.S. PATENT DOCUMENTS

| | | | |
|---|---|---|---|
| Re. 4,060 | 7/1870 | Fischbeck | 190/122 |
| Re. 7,164 | 6/1876 | Jessup | 190/37 |
| D. 76,279 | 2/1928 | Baetz . | |
| 80,548 | 8/1868 | Jenkinson | 190/37 |
| 797,495 | 8/1905 | Clark | 190/37 |
| 892,533 | 7/1908 | Maddux . | |
| 1,068,189 | 7/1913 | Waldschmitt, Jr. | 190/37 |
| 1,191,677 | 7/1916 | Dorris . | |
| 1,339,653 | 5/1920 | Katz | 190/127 X |
| 1,967,160 | 7/1934 | Plotkin | 190/49 |
| 2,388,297 | 11/1945 | Slaughter | 190/37 |
| 2,438,591 | 3/1948 | Wheary, Jr. | 190/37 |
| 2,532,154 | 11/1950 | Duskin | 190/26 |
| 2,895,574 | 7/1959 | Koffler | 190/37 |
| 2,950,793 | 8/1960 | Axtell | 190/49 |
| 3,021,930 | 2/1962 | Storey | 190/37 X |
| 3,955,656 | 5/1976 | Kashinski | 190/41 |
| 4,163,484 | 8/1979 | Delaney | 190/18 |
| 4,418,804 | 12/1983 | Bradley et al. | 190/127 X |
| 4,522,288 | 6/1985 | Wickman et al. | 190/106 |
| 4,669,587 | 6/1987 | Zitt | 190/37 X |
| 4,714,143 | 12/1987 | Saliba | 190/115 |
| 4,744,445 | 5/1988 | Anderson et al. | 190/37 X |

FOREIGN PATENT DOCUMENTS

| | | | |
|---|---|---|---|
| 7340211 | 5/1975 | France | 190/18 R |

*Primary Examiner*—Stephen Marcus

*Attorney, Agent, or Firm*—Eckert Seamans Cherin & Mellott

[57] ABSTRACT

A protective pad for an article of luggage and an article of luggage with a protective pad are disclosed. The pad has a foot section spacing the base from any surface luggage, the foot section spacing the base from any surface underlying the article of luggage when rested thereon. A side guard is integral with the foot section and extends from the foot section, the side guard having a proximal leg to be disposed on the base of the luggage, adjacent the foot section, and a distal leg oriented at an angle to the proximal leg such that the side guard defines a protective projection extending from the luggage at the feet around a lower corner of the article of luggage and up a sidewall. A shank can be embedded in a connecting section molded between the feet, and holes can be provided for receiving fasteners extending through the feet and also through the distal end of the side guard. At least some of the holes and fasteners can be aligned to the side guard, for bearing a tensile load.

14 Claims, 2 Drawing Sheets

LUGGAGE-PROTECTIVE PAD INCLUDING INTEGRAL FEET AND BUMPER

BACKGROUND OF THE INVENTION

1. Field of the Invention

This invention relates to the field of luggage construction, and in particular to a protective and supportive element for luggage, contoured to define a protective bumper pad for mounting at opposite ends of an article of luggage. Integral feet space the base of the luggage from any underlying surface. The elements protect the area at the lower edges of the luggage sidewall from wear and impact, while supporting the contour of the luggage adjacent the bottom and sidewall.

2. Prior Art

Many articles of luggage are provided with feet to protect against wear. Typically the feet are defined by discrete projecting button-like formations that are individually attached at each of the four corners of the base of an article of luggage. Examples of luggage feet of this kind embodied in plastic, attached individually to the base of an article of luggage by means of fasteners, are disclosed, for example, in U.S. Pat. Nos. 2,950,793-Axtell and 2,895,574-Koffler. In each case, the feet are separate and discrete structures which are individually attached. The feet serve to protect the base of the luggage by spacing the base from any surface on which the article of luggage is placed.

U.S. Pat. No. 4,163,484-Delaney teaches a foam rubber protective strip which is adhesively attached to an article of luggage at any chosen point, preferably at spaced points all around the sidewalls of the luggage. In a manner similar to the foregoing patent disclosures of discrete spaced feet, the protective strips in the Delaney patent are not connected to one another except by virtue of being attached to the same article of luggage, which is of a rigid box construction. There is no structural benefit to the luggage derived from using these protective feet.

U.S. Pat. Nos. 1,191,677-Dorris; 2,532,154-Duskin; and, Des. 76,279-Baetz disclose protective strips which extend transversely around a corner of an article of luggage rather along the edge, namely along a strip on the base and sidewalls adjacent the base, in the area of the corners and lowermost edge. The strips are added-on layers of the same material comprising the bag, e.g., leather. Such flexible-layer protectors minimize abrasion damage of the underlying layers of the bag; however, the surfaces of the protective strips themselves wear, fray and otherwise become unsightly. A simple layer of leather likewise does not support the shape of the bag.

Flexible bags of this type may be made of simple fabric, the shape of the bag being maintained by a skeleton of wire reinforcing supports, defining the outlines of a box. The wire supports are sewn into the seams between the adjacent wall panels. The wire supports at least initially are effective, but if the bag should be crushed the supports can be deformed, and are difficult or impossible to straighten again. If skeletal supports are not used, then the bag may seem unacceptably flimsy. Typically the wire supports are enclosed in piping sewn along the edges of the bag, where the piping also provides some protection to the edges of the bag.

U.S. Pat. No. 1,967,160-Plotkin discloses a flexible protective outer strip which is sewn onto the article of luggage along the lowermost corner and part way around the corners of the base. Plotkin's protective strip is used together with discrete feet; however, the strip is not structurally or integrally attached to the feet. On the contrary, although Plotkin employs strips of angle iron to reinforce the corner between the sidewalls and the base, the feet and/or protective strip are not connected to the angle iron, the angle iron having a gap to allow space for the feet to be attached to the luggage material via fasteners through the protective flexible strip.

U.S. Pat. No. 3,955,656-Kashinski discloses a protective strip which extends around right angles adjacent a midpoint of the luggage top, bottom and ends. A removable bumper band protects the article of luggage at the abutting edges of a hinged top and bottom. Kashinski's strip is not directly attached to the luggage and in fact could not readily be attached without fixing the halves of the luggage together or at least obstructing their opening and closing.

In the event discrete feet are individually connectable to an article of luggage and/or if a flexible strip is separately attached to an article of luggage adjacent the junction between the base and sidewall or adjacent the feet, production steps are required for attaching together each of the items to be included.

There is a need to incorporate both protective strips and feet in an easily manufactured and installed luggage element, the protective strips protecting the luggage from impact and the feet not only protecting from impact but also spacing the base of the luggage above any surface on which the luggage is rested. Underlying surfaces may be wet, dirty or otherwise inappropriate for contact with the base of the luggage. There is also a need to structurally support the various portions of an article of luggage, in particular to retain a defined shape in more-or-less flexible articles of luggage in a manner that allows the articles to be crushed and then causes them to resume proper shape. While numerous disclosures of feet and protective strips appear in the prior art, the art fails to provide a structurally supportive integral foot and protective pad device which will protect and reinforce an article of luggage.

SUMMARY OF THE INVENTION

It is an object of the invention to structurally reinforce and also to protect an article of luggage.

It is another object of the invention to provide a monolithic structure for attachment as a unit to the luggage, the structure including protruding feet for spacing the luggage above a supporting surface and a resilient impact pad adapted to a surface contour of the luggage.

It is also an object of the invention to improve protection of the luggage and reduce the possibility of loss of the feet of luggage by means of more durable luggage feet formed integrally with a shape retaining pad which may include an embedded stiffening member.

It is a further object of the invention to reinforce a flexible article of luggage between its base and sidewall using a light weight shape-holding structure attachable thereto.

These and other objects are accomplished by a protective pad for an article of luggage and/or an article of luggage with the protective pad. The pad has a foot section to be disposed on a base of the luggage, the foot section spacing the base from any surface underlying the article of luggage when rested thereon. A side guard is integral with the foot section and extends from the foot section, the side guard having a proximal leg to be disposed on the base of the luggage, adjacent the foot section, and a distal leg oriented at an angle to the proximal leg such that the side guard defines a protective projection extending from the luggage at the feet, around the lower corner of the luggage up to the distal end of the side guard on the side of the luggage. The protective pad may be resilient plastic, for example foamed polyurethane, and may entirely enclose a reinforcing stiffener or shank.

BRIEF DESCRIPTION OF THE DRAWINGS

There are shown in the drawings the embodiments which are presently preferred. It should be understood, however, that the invention is not limited to the precise arrangements and instrumentalities shown in the drawings, and is capable of embodiment in other groupings and configurations of elements according to the appended claims. In the drawings.

DETAILED DESCRIPTION OF THE PREFERRED EMBODIMENTS

Figure 1:
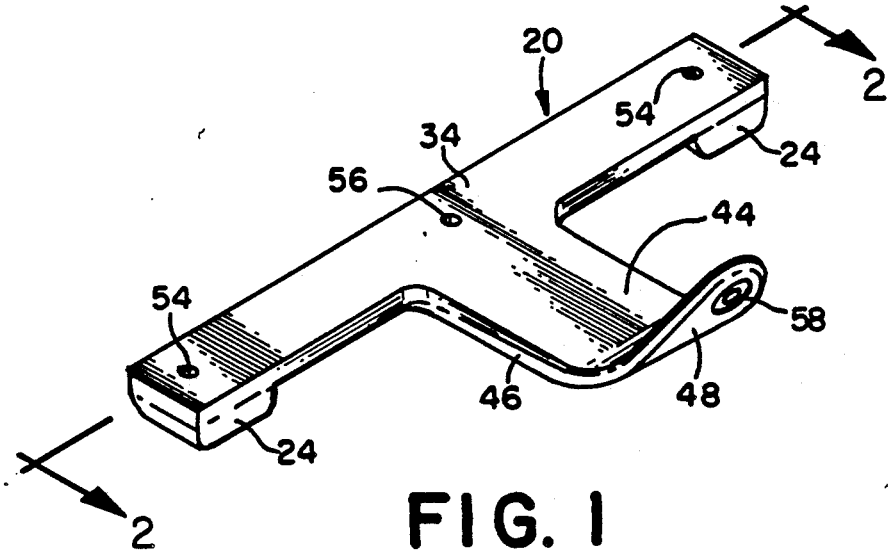
FIG. 1 is a perspective view of a protective foot and pad structure according to the invention.

Referring to FIG. 1, a monolithic protective pad structure 20 for an article of luggage is defined by at least one foot section 24 to be attached to the base of an article of luggage, and a side guard 44 which extends along the base from foot 24, following the contour of the luggage upwardly around a sidewall of the luggage to a vertical section 48, which ends at a tapered end which may be attached at a short distance up the sidewall. Pad 20 is resilient and retains its shape such that the pad protects and supports the luggage on both the base and side. Preferably, a pair of spaced feet 24 are included. The feet can be attached to the base wall of the luggage directly, and are connected together integrally by an intermediate section 34, attached to the feet and/or to the base. The feet 24 are provided with through-holes 54, by which the protective pad is attached to the base of an article of luggage, for example by means of rivets which extend through feet 24 and through the base wall of the luggage.

A reinforcing shank 52 can be embedded in the feet 24 and in the intermediate section 34 which spaces the feet apart, the shank 52 extending to the point of through-holes 54 and thus making the pad structurally attachable very securely to the base of the article of luggage. The shank 52 structurally supports the luggage at the base, whereby a relatively flexible base performs adequately. In FIG. 1, an additional intermediate through-hole 56 is provided for attaching the shank to the article of luggage at a midpoint along the shank, in the same manner as feet 24 are attached to the luggage, namely by means of a fastener such as a rivet or the like which extends through shank 52, through the resilient material in which shank 52 is embedded, and through the the base wall of the luggage.

Another through-hole 58 for a fastener is preferably provided in the upwardly-extending section 48 of the side guard member 44. The upwardly extending section 48, at the distal end of side guard 44, turns upwardly relative to connecting section 46 by which the side guard 44 connects to the remainder of the protective pad 20. Preferably, the entire protective pad 20, with the exception of the embedded shank 52, is an integrally molded monolithic structure of flexible material which retains its shape. A preferred material is foamed polyurethane, for good padding, good durability and attractive surface characteristics. Examples of products which are integrally moldable (with optional stiffening shank) and which retain their shape, include rubbers, silicone products, polyvinyl chloride, polyesters, polyurethane, polyolefins (polyethylene, polypropylene, etc.), halogenated hydrocarbons (TEFLON, nylon, etc.), and acrylic polymers or copolymers.

Figure 2:
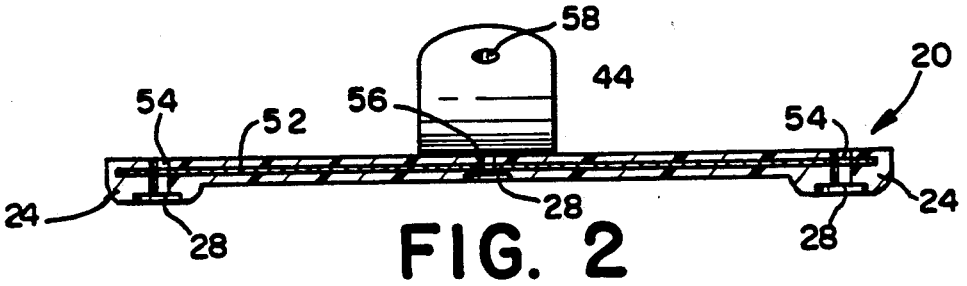
FIG. 2 is a section view taken along lines 2—2 in FIG. 1.

As shown in FIG. 2 in section view, the through holes 54 through feet 24 are provided with counterbores 28 on the outerfacing sides such that the article of luggage will rest on the resilient portion of feet 24 and not on the head of a rivet or other fastener which may protrude from through-hole 54. Feet 24, spacing section 34 and side guard section 44 are all beveled on their outer edges, presenting a smooth transition from the surface of the article of luggage to the pad surface. The distal end of upward section 48 is preferably rounded.

Figure 3:
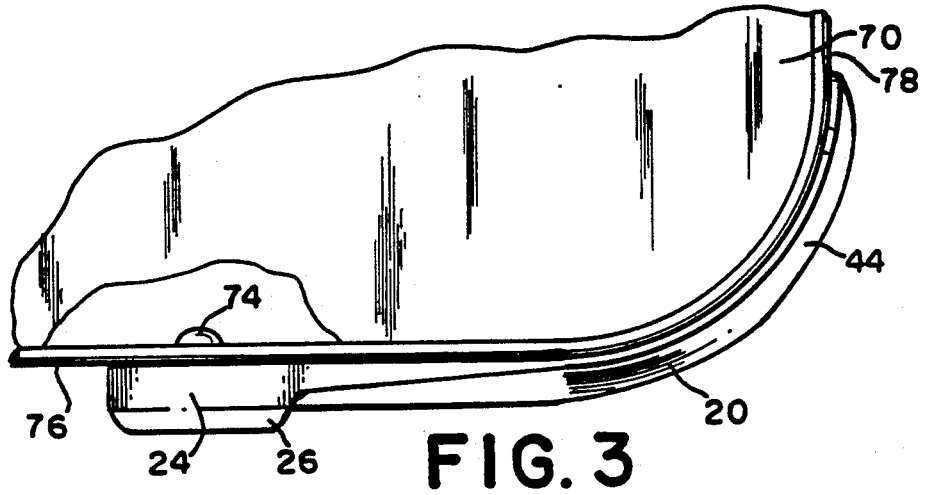
FIG. 3 is a partial elevation view of the protective pad, shown attached to an article of luggage, the article of luggage being shown partially broken away.

FIG. 3 illustrates the connection of protective pad 20 to an article of luggage 70. The luggage 70 has a base wall 76, which is on the bottom when the luggage is placed upright, and sidewalls including the endmost sidewall 78, against which the side guard 44 bears and is attached by means of a fastener through hole 58. Feet 24 absorb abrasion and space the base 76 of the article of luggage 70 out of puddles, dirt or other hazards for the luggage, while side guard section 44, both along the base and along the corner of the luggage, protects the luggage from impacts which would otherwise tend to collapse or damage the corner of the luggage between base 76 and side 78. The pad retains its configuration, helping to support and shape luggage made of flexible fabric or the like. Rivet 74, passing through foot 24, and preferably also a shank embedded therein, attaches the pad 20 to the luggage 70. The head of the fastener 74 may protrude inwardly without problems. A washer under the inside head of fastener 74 is recommended if the pad is attached directly to a flexible material. The outside end of fastener 74 is disposed within the height defined by the foot 24, and thus will not scratch or damage surfaces on which the luggage is placed, or over which the luggage may be pushed.

The protective pad can be usefully applied to rigid bags as well as flexible ones. However, one important characteristic of the invention is its tendency to resiliently return to its original configuration. In the event bag 70 is a flexible bag, for example made of a fabric or bonded fabric-and-plastic sheet material, pad 20 will shape the lower corner as shown in FIG. 3. When the bag is collapsed, the base 76 and end sidewall 78 can be forced toward one another, bending pad 20 at side guard section 44. In a conventional bag, wire skeletal supports disposed in the piping along the seams are the sole means retaining the box shape of the bag. A sharp bend at the corner of the would remain and a user might find it difficult to bend back the wire skeleton to nominal shape. According to the invention, the flexible guard section 44 is well connected to the bag by connector 74 and by the integral nature of the side guard and the foot section but also allows flexing. A heavy or easily deformed wire skeleton is therefore not necessary to hold the bag shape. If a wire skeleton is used, pad 20 resists collapse of the corner of the bag. If the bag is collapsed, pad 20 resiliently urges the skeleton into correct shape.

Figure 4:
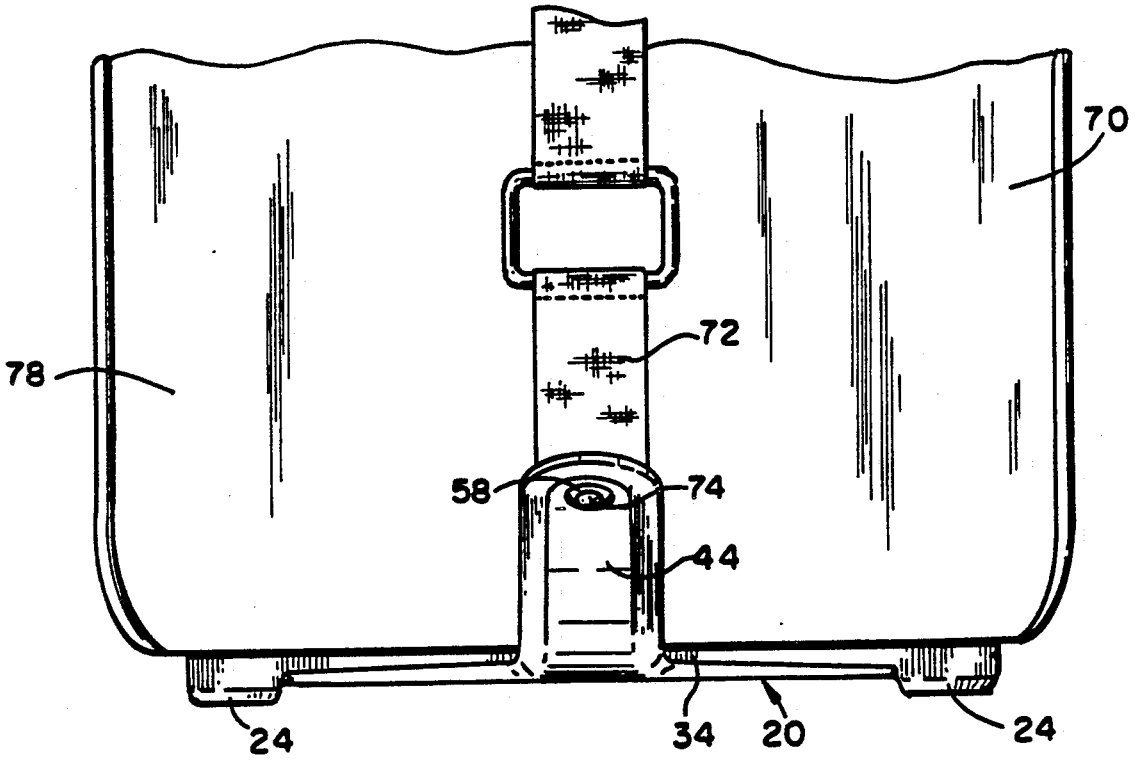
FIG. 4 is an end elevation view from the right in FIG. 3.

FIG. 4 is an end view of an article of luggage, illustrating the protective pad 20 as mounted. The article of luggage may also have a side strap 72 as shown, leading to a shoulder strap, fixed on opposite ends to the article of luggage. By attaching side guard section 44 to the luggage using a fastener through through-hole 58 and strap 72, a structural interconnection is achieved which supports the luggage not only along the base wall 76 between feet 24, and at the corner between the base and sidewall, but furthermore causes the whole bag, which is preferably flexible, to be transported on resilient, structurally stable supports. The structure of pad 20 accommodates tension on strap 72 (or tension on a handle or the like which may be connected via a similar structural configuration), which tension results from a load carried in the article of luggage. A further through-hole 56 may be used for another fastener, hole 56 being aligned with hole 58 in the distal end of section 44, such that tension on section 44 cannot bow or twist section 34, between feet 24. Inasmuch as the through-holes 58, 56 on the side guard 44 and foot-connecting section 34 are aligned to side guard 44, tension is transmitted to the luggage along the side and corner. In any event, a resilient connection is provided which will carry the entire article of luggage and its contents, preventing stresses on the handle, strap 72 or the like from partly collapsing even a relatively lightweight flexible article of luggage.

Embedded shank 52 may be included to further reinforce the base of the luggage. Normally, a central fastener in hole 56 will not be necessary if section 34 is reinforced. The reinforcement can be provided by a more-rigid body embedded in section 34, for example a hard plastic or metal strip or shank 52. The reinforcement is preferably a steel shank, for example one sixteenth inch thick. Although dimensions will vary with the size of bag and expected load, in connection with a carry-on bag having feet spaced approximately 8 inches (20 cm), a 1 inch (2.5 cm) wide by one sixteenth inch (0.2 cm) thick strip is usually appropriate, the feet in that case spacing the base of the luggage from any underlying surface by approximately by ½ inch (1.3 cm), and the connection section 34 between the feet (i.e., the section enclosing shank 52) being about 0.3 inches (0.8 cm). The width and thickness of side guard section 44 preferably taper off towards its distal end, being of equal width to connecting section 34 at the proximal end of the side guard and including a beveled and rounded distal end leading smoothly to the surface of the bag as shown.

The resilient portions of pad 20, including the material enclosing optional reinforcing shank 52, are preferably monolithic foamed micro-cellular polyurethane, or a comparable thermoplastic or thermoset material. The polyurethane can be manufactured using a moderately low viscosity two component polyether based polyurethane foam that produces a flexible microcellular foam with good physical strength, resilience and shape "memory". Polyurethane foam of this type also gives good skin definition and gloss and need not be finished extensively. According to the preferred embodiment, the polyurethane is formed to a molded overall density of about 0.5–0.6 gm/cc. A surface hardness (Shore A) of 58–72 is preferred (i.e., 0.55–0.60 gm/cc). The polyurethane has a tensile strength on the order of 620–780 psi and will elongate 360–400%. Tear strength is about 115–120 pli and at 20° F. a ½ inch (1.3 cm) test specimen with a one sixteenth inch (0.2 cm) V-cut flexed 22,000 times before failing.

The connecting holes 54, 58, provided for fastening the pad 20 to the article of luggage are preferably 9/64 inches (0.36 cm). The midpoint third hole 56 is optional, but is advisable absent a reinforcing shank for a secure attachment between the pad 20 and the article of luggage, especially in the event that a side strap will cause lateral flexing of the connection between feet 24 and the base of the article of luggage.

Figure 5:
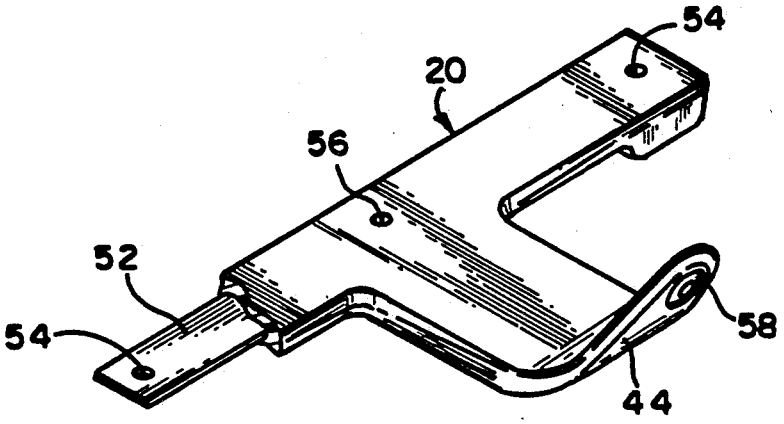
FIG. 5 is a perspective view of the protective pad, shown cut away to expose an embedded shank.

FIG. 5 shows the structural relationship between the flexible sections of pad 20 and a metal or hard plastic shank 52 embedded therein. It is also possible to extend the embedded reinforcing member 52 part way through side guard 44, or even all the way into the distal end adjacent through hole 58 for attachment to the article of luggage. The character and length of the shank or the like can be used to control the flexibility and crush-absorbing characteristics of the pad such that with flexible luggage, free resilient flexing of the device not only retains shape but also reduces the possibility of damage to the bag.

The invention as so disclosed is a protective pad 20 for an article of luggage 70, the article of luggage 70 having a base 76 upon which the article 70 can be rested and a sidewall 78 extending upwardly at an angle from the base 76, the protective pad 20 comprising a foot section 24 to be disposed on the base 76, the foot section 24 spacing the article from a surface underlying the article 70 when rested thereon. A side guard 44 integral with the foot section 24 and extending from the foot section 24 has a proximal leg 46 disposed on the base 76 adjacent the foot section 24 and a distal leg 48 oriented at an angle to the proximal leg 46, the distal leg 48 extending continuously from the foot section 24 along the base 76, around the angle and at least part way up the sidewall 78, whereby the article of luggage is protected on the base 76 and sidewall 78 and its shape is reinforced.

The foot section 24 has a plurality of spaced protrusions joined together by a spacer section 34, the side guard 44 being connected integrally with the foot section 24 at said spacer section 34. The foot section 24, spacer section 34 and side guard 44 are preferably an integrally molded resilient body, and the pad 20 preferably further comprises a shank 52 embedded at least in the spacer section 34, the shank stiffening the protective pad. The resilient material is preferably foamed polyurethane and the shank is preferably hard plastic or metal, e.g., steel.

The side guard 44 and at least one of the foot section 24 and the spacer section 34 are provided with through holes 54, 58 for receiving fasteners 74 for attaching the protective pad 20 to the article of luggage 70. The through holes can be disposed at each of the foot protrusions 24 and also adjacent a free end of the distal section 48 of the side guard 44.

The invention also relates to an article of luggage 70 including protective pad 20 as described. The luggage has a base 76 and sidewalls 78 attached to the base 76, the base 76 and sidewalls 78 defining a receptacle with an inside and an outside, the sidewalls 78 being disposed at an angle relative to the base 76. At least one pair of feet 24 are attached to the base 76, the feet 24 being spaced apart and defining protrusions whereby the article of luggage is spaced from any underlying surface on which it is placed. A spacer section 34 extends between the feet, the spacer section 34 being connected to the feet 24 by resilient material integrally molded together in the spacer section 34 and the feet 24. The luggage can be a flexible fabric structure and may have skeletal wire supports.

The invention having been disclosed, a number of variations within the scope of the invention will now become apparent to persons skilled in the art. Reference should be made to the appended claims rather than the foregoing specification to properly assess the breadth of the invention in which exclusive rights are claimed.

What is claimed is:

1. An article of luggage, comprising:

a base and sidewalls attached to the base, the base and sidewalls defining a receptacle with an inside and an outside, the sidewalls being disposed at an angle relative to the base, at least one of the base and the sidewalls being formed of a flexible material such that the article of luggage is subject to deformation by bending the sidewalls relative to the base;

a foot section having at least one pair of feet, the foot section being attached to the base, the feet being spaced apart and defining protrusions spacing the article of luggage from an underlying surface when the article of luggage is placed thereon;

a spacer section extending between the feet, the spacer section being connected to the feet; and, a sidewall guard section connected to one of the sidewalls, and also connected to at least one of the feet and the spacer section, the feet, the spacer section and the sidewall guard section being integrally connected together by resilient wear resistant molded material which retains a predetermined shape, the molded material bridging across the spacer section and the feet and the sidewall guard section, to define a one-piece protective pad having a thickness sufficient to space adjacent portions of the article of luggage from a surface against which the article of luggage can be rested, said deformation of the sidewalls relative to the base being limited substantially exclusively by the protective pad;

whereby the article of luggage is resiliently protected at the base and the sidewalls.

2. The article of luggage of claim 1, wherein the foot section has a plurality of spaced protrusions joined together by the spacer section, the side guard being connected integrally with the foot section and said spacer section.

3. The article of luggage of claim 2, further comprising a shank embedded at least in the spacer section, the shank further stiffening the protective pad.

4. The article of luggage of claim 3, wherein the molded material is foamed polyurethane and the shank is steel.

5. The article of luggage of claim 2, wherein the side guard and at least one of the foot section and the spacer section are provided with through-holes, and further comprising fasteners in the through-holes, attaching the protective pad to at least one of the base and the sidewalls.

6. The article of luggage of claim 5, wherein at least some of the through-holes are aligned to the side guard.

7. The article of luggage of claim 5, wherein said through-holes are disposed at each of the protrusions and adjacent a free end of the distal section of the side guard.

8. The article of luggage of claim 3, comprising two said protective pads, four of said feet being disposed in two pairs at opposite ends of the base of the article of luggage, the feet in each said pair being integrally attached to a spacer section with a shank embedded therein and to a sidewall guard section, the sidewall guard sections extending around sidewalls of the article on opposite ends of the article.

9. The article of luggage of claim 5, wherein the protective pads at each of said opposite ends are attached to the base and to the sidewalls by fasteners extending through the base and sidewalls and through holes in the protective pads at the feet and at a free end of the distal section.

10. The article of luggage of claim 1, wherein the molded material is chosen from the group consisting of foamed polyurethane, rubber, silicone, polyvinyl chloride, polyester, polyurethane, polyolefin, halogenated hydrocarbon, acrylic polymers and copolymers, and mixtures containing them.

11. The article of luggage of claim 1, further comprising at least one of a strap and a handle for carrying the luggage, said at least one of the strap and the handle being structurally connected to said protective pad.

12. The article of luggage of claim 11, wherein said at least one of the strap and the handle is structurally connected to said protective pad at the side guard.

13. The article of luggage of claim 12, wherein the side guard follows a curve around the base and said one of the sidewalls, whereby the protective pad cushions said one of the strap and the handle relative to a load carried in the article of luggage.

14. The article of luggage of claim 1, wherein the pad extends externally on the article, upwardly along an end sidewall of the article.

* * * * *